United States Patent [19]

Carrier et al.

[11] Patent Number: 4,635,527

[45] Date of Patent: Jan. 13, 1987

[54] COMPACT MOLDED BULKHEAD FOR A TUBE-CLUSTER ROCKET LAUNCHER

[75] Inventors: Christian J. L. Carrier; Charles J. Shea, both of Ste-Foy, Canada

[73] Assignee: Minister of National Defence of Her Majesty's Canadian Government, Ottawa, Canada

[21] Appl. No.: 752,600

[22] Filed: Jul. 8, 1985

[30] Foreign Application Priority Data

Jul. 9, 1984 [CA] Canada ..... 458480

[51] Int. Cl.[4] ..... F41F 3/042

[52] U.S. Cl. ..... 89/1.816; 89/1.8

[58] Field of Search ..... 89/1.816, 1.819, 1.817, 89/1.8, 13.1, 12

[56] References Cited

U.S. PATENT DOCUMENTS

| | | | |
|---|---|---|---|
| 2,609,730 | 9/1952 | Bergström | 89/1.817 |
| 2,763,189 | 9/1956 | Grill | 89/1.817 |
| 3,048,086 | 8/1962 | Robert et al. | 89/1.817 |
| 3,106,863 | 10/1963 | Robert et al. | 89/1.817 |
| 3,172,330 | 3/1965 | Lidmalm et al. | 89/1.817 |
| 3,315,565 | 4/1967 | Nash | 89/1.816 |
| 3,342,104 | 9/1967 | Robert | 89/1.817 |
| 3,456,552 | 7/1969 | Nash | 89/1.817 |
| 3,841,197 | 10/1974 | Morrisey | 89/1.816 |
| 3,988,961 | 11/1976 | Banta et al. | 89/1.816 X |
| 4,114,510 | 9/1978 | Prince et al. | 89/12 |
| 4,296,669 | 10/1981 | Debona et al. | 89/1.816 |

FOREIGN PATENT DOCUMENTS

| | | |
|---|---|---|
| 2116754 | 7/1972 | France . |
| 2455724 | 11/1980 | France . |
| 1283941 | 8/1972 | United Kingdom . |

*Primary Examiner*—David H. Brown

*Attorney, Agent, or Firm*—Leonard Bloom

[57] ABSTRACT

The invention disclosed is a novel bulkhead structure for use with rocket launchers which employ a plurality of cylindrical launch tubes. The bulkhead includes openings which are aligned with corresponding launch tube openings. The bulkhead openings are counterbored to receive the launch tube ends and to provide a smooth transition between the launch tubes and the bulkhead to prevent rocket-to-bulkhead interference when the rockets are launched.

8 Claims, 4 Drawing Figures

COMPACT MOLDED BULKHEAD FOR A TUBE-CLUSTER ROCKET LAUNCHER

This invention relates to rocket launchers and in particular to a novel bulkhead structure for use with rocket launchers.

Rocket launchers of the tube-cluster type consist mainly of a convenient number of thin-walled launch tubes held together by appropriate securing means such as bands, adhesive and a stressed-skin shell. Firing circuitry and a suspension interface are also provided. To position the launch tubes within the cluster, to protect the tubes' fore ends from the rocket blast and to reinforce the whole structure, both ends of the launch tube cluster are generally fitted with some form of bulkhead.

To minimize the cross-section of the rocket launcher for aerodynamic considerations, the launch tubes are often arranged in the well-known compact hexagonal pattern, with the tubes touching each other at up to six points. The problem is to design a bulkhead which will fit onto such a compact cluster, which will still be strong and erosion-resistant and which will not interfere with the rockets during launch.

Since the tube cluster is a compact pattern, there is no clearance space around the entire circumference of any one tube. The simplest bulkhead is thus a sheet-metal one stamped with flanged openings in an appropriate hexagonal pattern, the flanged openings being smaller in diameter than the inner diameter of the launch tubes. At assembly of the bulkhead onto the tube cluster, the flanges are aligned with the launch tubes and made to extend into the launch tubes and are then swaged or otherwise expanded outwardly against the inner surfaces of the tubes until the bulkhead is solidly fastened to the tube cluster. Such a rocket launcher assembly is described in Canadian Pat. No. 896,928 which issued Apr. 4, 1972 to John J. Nash.

This simple design is perfectly adequate in launchers for folding fin-type rockets. However, it must be refined for launchers for wrap-around fin-type rockets, such as the CRV7 (trademark) rocket employed by the Canadian Forces, so as to prevent fin-to-bulkhead interference at launch. The refinement may consist of machining a taper on the bulkhead flange or it may consist of bonding a tapered "choke ring" into the fore end of each tube just before the flange. The taper on the ring is to provide a ramp for the wrap-around fins to ride on, as the rocket passes through the bulkhead, thus preventing interference between the fins and the bulkhead. Unfortunately, both refinements may not be adequate under actual conditions of use.

Indeed, with reference to the tapered-flange sheet-metal bulkhead, the hot blast from the first rockets of a ripple firing can distort the bulkhead flanges in adjacent tubes and the fins of the subsequently fired rockets may then catch on the bulkhead. It is emphasized that any rocket-to-launcher interference can result in a catastrophy. The rocket(s) can rip the bulkhead off the launcher and/or the rocket's nozzle-fin assembly can be damaged. In both cases, the rocket's flight will be highly erratic and can jeopardize the safety of the launching aircraft.

With respect to the flanged bulkhead with choke rings, the ring-to-tube bond is potentially unreliable. This is because the labor-intensive bonding procedure is unsuitable for semi-skilled workers and it is difficult to implement meaningful quality control procedures.

Seemingly sound choke rings can be melted and blasted away during ripple firing, resulting in catastrophic rocket-to-bulkhead interference. Also, concern has been voiced over possible degradation of the bond because of aging and moisture.

Further, existing sheet metal bulkheads have been found to be unsatisfactory under certain conditions, e.g., permanent deformation has occurred when subjected to load testing below the design limits. Corrosion problems have also been reported.

According to the invention, a novel bulkhead structure and a rocket launcher incorporating such structure are contemplated; said rocket launcher includes a plurality of open-ended cylindrical launch tubes secured together in a cluster with said bulkhead adapted to be attached to an end of said tube cluster; said bulkhead comprising a plate with a plurality of counterbored circular openings in said plate located to align with the open ends of the launch tubes, said counterbored openings each defining a first diameter portion and a second larger diameter portion respectively with said first and second diameters being substantially equal to the inner and outer diameters, respectively, of said launch tubes, such that in use with each launch tube and aligned with and disposed in a respective one of said counterbored bulkhead openings a smooth transition between the interiors of said launch tubes and the bulkhead is provided to prevent rocket-to-bulkhead interference at launch.

As a further feature each of said counterbored openings in said bulkhead provides a step or shoulder between said first and second diameter portions against which the leading edge of a respective launch tube abuts when in use. Still further according to the invention the tubes of the cluster are in close contacting relation with each other with the second larger diameter portions coinciding with one another at points corresponding to the points where the tubes touch one another so that the launch tube ends may be structurally supported by the bulkhead except where the larger diameter portions coincide with one another and where not supported by the bulkhead each tube being supported by contact with adjacent tubes. Preferably said bulkhead plate is made of a glass fiber reinforced nylon material.

By the use of the invention the several disadvantages of the known prior art structures as enumerated above are substantially eliminated. The manner in which the invention achieves these advantages will become apparent from the following description of a preferred embodiment of same.

In the drawings which illustrate a preferred embodiment of the invention:

Figure 2:
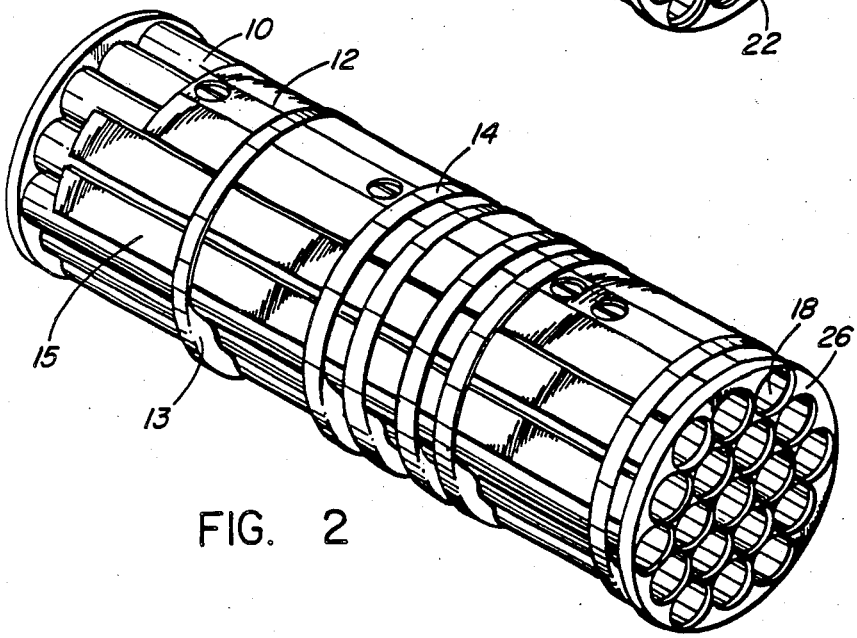
FIG. 2 is a perspective view, similar to that of FIG. 1, of a rocket launch assembly including the novel bulkhead according to the invention.
Figure 3:
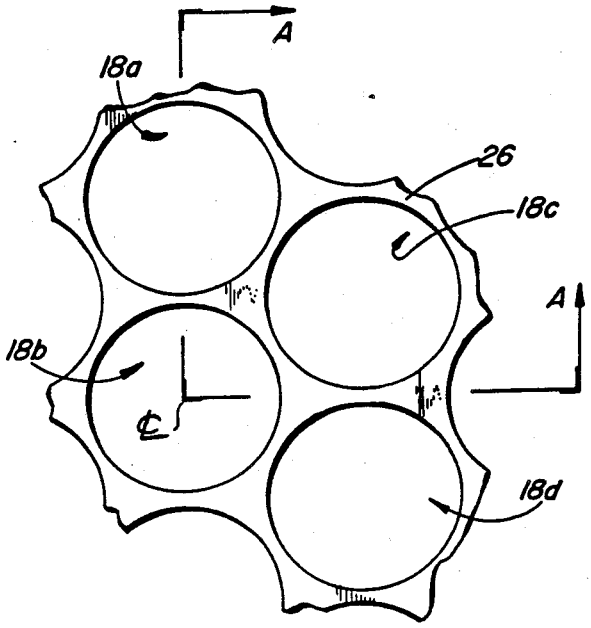
Figure 4:
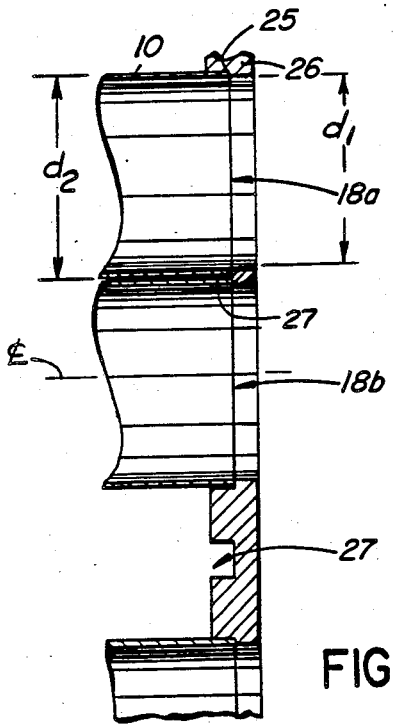

FIG. 3 is a front view of part of the end portion of the rocket launcher of FIG. 2, illustrating the arrangement of several bulkhead openings; and FIG. 4 is a side elevation of a section of FIG. 3 taken along line A—A which illustrates the flush connection between the rocket launcher and the bulkhead according to the invention and the alignment of the launch tubes with corresponding bulkhead openings.

Figure 1:
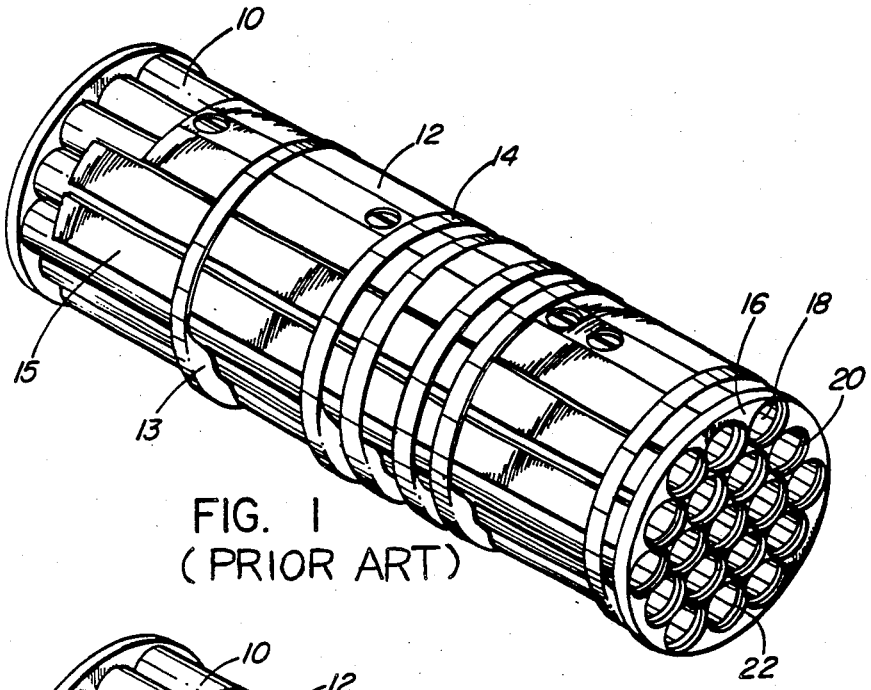
FIG. 1 (PRIOR ART)
FIG. 1 is a perspective view of a prior art rocket launcher assembly including a sheet metal bulkhead and a choke ring.

Referring to FIG. 1, which illustrates a prior art rocket launcher, the launcher is seen to comprise a plurality (nineteen) of open-ended cylindrical launch tubes 10. The tubes, along with an aluminum suspension beam 12, various spacer blocks 13 and sticks 15, are clustered together in the compact hexagonal pattern, with the tubes contacting each other at up to six points, using steel bands 14. A sheet metal bulkhead 16 is secured to the tube cluster 10 at each end thereof. The bulkhead 16 includes a plurality of openings 18 which align with the open ends of the launch tubes 10. The bulkhead 16 includes inwardly directed flanges 20 associated with each of the openings 18 which extend into the openings in launch tubes 10 and are expanded outwardly into contact with the inner surfaces of the launch tubes to secure the bulkhead to the tube cluster. A tapered choke ring 22 is provided in the fore end of each of the launch tubes 10 just inside and adjacent to the flanges 20.

Turning now to applicant's invention, as seen in FIG. 2, the typical rocket launcher of FIG. 1 now includes the novel bulkhead 26 in the form of a flat circular plate 26 of structurally appropriate thickness (in this case about 0.77 inch i.e. about 19.5 mm), including an arrangement of circular openings 18 matching the arrangement of the tube cluster openings (the tubes 10 being clustered in the same manner as described in relation to FIG. 1).

With reference to FIGS. 3 and 4, the arrangement of several bulkhead openings 18*a*, 18*b*, 18*c* and 18*d* is illustrated. As best seen in FIG. 4, the bulkhead 26 includes counterbored openings such as 18*a* and 18*b*, each such opening defined by a first portion of diameter $d_1$ and a larger second portion of diameter $d_2$ (defined by the counterbore). In the specific embodiment illustrated for use with 2.75" (about 67.5 mm) diameter rockets, $d_1$ is about 2.88" (about 73 mm) and $d_2$ is about 3.01" (about 76.5 mm). The bulkhead 26 is about 0.77" (about 19.5 mm) thick. The counterbore is about one-half the thickness of the bulkhead, i.e., about 0.38" (about 9.8 mm) in depth. The inner diameter of the launch tubes 10 closely matches the smaller first diameter $d_1$ to provide a smooth transition from launch tube interior to bulkhead. The outer diameter of the launch tube corresponds to the larger second diameter $d_2$, such that in operation the leading edge of each launch tube 10 engages a bearing surface in the form of a step or shoulder 25 on the bulkhead 26.

At the points where the adjacent tubes 10 of the cluster touch each other, similarly the counterbores coincide as shown at 27.

At assembly, each bulkhead opening 18 is aligned with a corresponding launch tube opening. The bulkhead is fitted on the tube cluster until each individual launch tube 10 abuts the bottom of the corresponding counterbored opening in the bulkhead, i.e., against shoulder 25. The end of each launch tube 10 is thus structurally supported by the bulkhead 26 over most of the tube perimeter, and where it is not supported by the bulkhead, as at points 27, it is supported by the adjacent tubes. Also this arrangement positively aligns the tube openings 18 with their corresponding bulkhead openings, thus ensuring a smooth transition between each launch tube and the bulkhead. For added strength, the bulkhead may be fastened to the tube cluster with suitable means such as adhesive, mechanical fasteners and welding.

Any suitable material and/or manufacturing method can be used to fabricate the bulkhead. However, for small to moderate production runs of such an intricate component, we prefer to integrally mold it of a fiber reinforced synthetic resin, in accordance with state-of-the-art injection molding technology.

A 30% glass fiber reinforced nylon has been found suitable for this application. One such material is sold under the trademark Nylafil. It is strong, tough and shows very good resistance to erosion. With such materials, no additional anti-corrosion coating or other finishing operation, except trimming the sprues, is required. Other suitable molding materials may include various types of thermoplastic or thermosetting synthetic resins. Die-cast zinc or aluminum may also be employed. Alternatively, the bulkhead could be machined from a solid plate of any suitable material.

We claim:

1. A bulkhead for a rocket launcher wherein said rocket launcher includes a plurality of open-ended cylindrical launch tubes secured together in close contacting relation in a cluster with said bulkhead adapted to be attached to an end of said tube cluster; said bulkhead comprising a plate with a plurality of counterbored circular openings in said plate located to align with the open ends of the launch tubes, said counterbored openings each defining a first diameter portion and a second larger diameter portion respectively with said first and second diameters being substantially equal to the inner and outer diameters, respectively, of said launch tubes, such that in use with each launch tube end aligned with and disposed in a respective one of said counterbored bulkhead openings a smooth transition between the interiors of said launch tubes and the bulkhead is provided to prevent rocket-to-bulkhead interference at launch.

2. A bulkhead according to claim 1 wherein said bulkhead plate is made of a glass fiber reinforced nylon material.

3. A bulkhead according to claim 1, wherein each of said counterbored openings in said bulkhead provides a step or shoulder between said first and second diameter portions against which the leading edge of a respective launch tube abuts when in use.

4. A bulkhead according to claim 3 wherein the tubes of the cluster are in said close contacting relation with each other in a hexagonal pattern with the second larger diameter portions coinciding with one another at points corresponding to the points where the tubes touch one another so that the launch tube ends may be structurally supported by the bulkhead except where the larger diameter portions coincide with one another and where not supported by the bulkhead each tube being supported by contact with adjacent tubes.

5. In a rocket launcher assembly including a plurality of open-ended cylindrical launch tubes; means for securing said tubes together in close contacting relation in a cluster, and a bulkhead in the form of a plate attached to each end of said tube cluster, the improvement wherein said bulkhead includes a plurality of circular counterbored openings, said counterbored openings each defining a first diameter portion and a second larger diameter portion respectively with said first and second diameters being substantially equal to the inner and outer diameters, respectively, of said launch tubes, each launch tube end being disposed in a respective one of said counterbored openings in said bulkhead within said second larger diameter portion to provide a smooth transition between the launch tube interiors and the bulkhead to prevent rocket-to-bulkhead interference at launch.

6. A rocket launcher assembly according to claim 5, wherein the tubes of the cluster are in said close contacting relation with each other in a hexagonal pattern with the second larger diameter portions coinciding with one another at points corresponding to the points where the tubes touch one another so that the launch tube ends may be structurally supported by the bulkhead except where the larger diameter portions coincide with one another and where not supported by the bulkhead each tube being supported by contact with adjacent tubes.

7. A rocket launcher assembly according to claim 5 wherein each of said counterbored openings in said bulkhead provides a step or shoulder between said first and second diameter portions against which the leading edge of a respective launch tube abuts.

8. A rocket launcher assembly according to claim 7, wherein the bulkhead plate is made of a glass fiber reinforced nylon material.

* * * * *